US006968699B2

(12) United States Patent
Howell et al.

(10) Patent No.: US 6,968,699 B2
(45) Date of Patent: Nov. 29, 2005

(54) SECTOR STAGING COMBUSTOR

(75) Inventors: Stephen John Howell, West Newbury, MA (US); John Carl Jacobson, Melrose, MA (US); Timothy Patrick McCaffrey, Swampscott, MA (US); Barry Francis Barnes, Malden, MA (US)

(73) Assignee: General Electric Company, Schenectady, NY (US)

( * ) Notice: Subject to any disclaimer, the term of this patent is extended or adjusted under 35 U.S.C. 154(b) by 90 days.

(21) Appl. No.: 10/431,924

(22) Filed: May 8, 2003

(65) Prior Publication Data

US 2004/0221582 A1 Nov. 11, 2004

(51) Int. Cl.[7] ..... F02C 7/26; F02C 7/228; F02C 9/26

(52) U.S. Cl. ..... 60/776; 60/778; 60/788; 60/739; 60/746

(58) Field of Search ..... 60/739, 746, 747, 60/748, 737, 804, 788, 776, 778

(56) References Cited

U.S. PATENT DOCUMENTS

| | | | | | |
|---|---|---|---|---|---|
| 2,984,970 | A | | 5/1961 | Bertaux et al. | |
| 3,713,588 | A | | 1/1973 | Sharpe | |
| 4,027,473 | A | * | 6/1977 | Baker | 60/739 |
| 4,112,676 | A | | 9/1978 | DeCorso | |
| 4,194,358 | A | | 3/1980 | Stenger | |
| 4,253,301 | A | | 3/1981 | Vogt | |
| 4,305,255 | A | | 12/1981 | Davies et al. | |
| 4,429,527 | A | | 2/1984 | Teets | |
| 4,817,389 | A | * | 4/1989 | Holladay et al. | 60/739 |
| 4,897,994 | A | * | 2/1990 | Shekleton | 60/778 |
| 4,936,090 | A | * | 6/1990 | Shekleton | 60/786 |
| 4,996,837 | A | * | 3/1991 | Shekleton | 60/804 |
| 5,036,657 | A | * | 8/1991 | Seto et al. | 60/739 |
| 5,197,278 | A | | 3/1993 | Sabla et al. | |
| 5,207,064 | A | | 5/1993 | Ciokajlo et al. | |
| 5,257,502 | A | * | 11/1993 | Napoli | 60/739 |
| 5,274,993 | A | * | 1/1994 | Keller | 60/737 |
| 5,289,685 | A | | 3/1994 | Hoffa | |
| 5,321,949 | A | * | 6/1994 | Napoli et al. | 60/739 |
| 5,331,815 | A | * | 7/1994 | Reinhold et al. | 60/748 |
| 5,373,694 | A | * | 12/1994 | Clark | 60/804 |
| 5,884,483 | A | * | 3/1999 | Munro | 60/739 |
| 5,966,925 | A | * | 10/1999 | Torikai et al. | 60/778 |
| 6,058,710 | A | | 5/2000 | Brehm | |
| 2001/0047650 | A1 | | 12/2001 | Muller et al. | |

FOREIGN PATENT DOCUMENTS

| | | |
|---|---|---|
| DE | 4412315 | 10/1995 |
| DE | 19508109 | 9/1996 |
| DE | 19720402 | 11/1998 |
| EP | 1199523 | 4/2002 |
| FR | 2694799 | 2/1994 |
| GB | 874502 | 8/1961 |

OTHER PUBLICATIONS

Traeger, "Fuel Nozzles," Aircraft Gas Turbine Engines Technology, 1979, pp: . i, ii, 242–247.

* cited by examiner

*Primary Examiner*—Ted Kim
(74) *Attorney, Agent, or Firm*—William S. Andes; Francis L. Conte

(57) ABSTRACT

A combustor includes outer and inner liners joined together by a dome to define a combustion chamber. A row of air swirlers is mounted in the dome and includes corresponding main fuel injectors for producing corresponding fuel and air mixtures. Pilot fuel injectors fewer in number than the main injectors are mounted in the dome between corresponding ones of the swirlers. Staged fuel injection from the pilot and main injectors is used for starting the combustor during operation.

24 Claims, 3 Drawing Sheets

SECTOR STAGING COMBUSTOR

The U.S. Government may have certain rights in this invention in accordance with Contract No. DAAE07-00-C-N086 awarded by the Department of the Army.

BACKGROUND OF THE INVENTION

The present invention relates generally to gas turbine engines, and, more specifically, to land vehicle turbine engines.

In a gas turbine engine, air is pressurized in a compressor and mixed with fuel in a combustor for generating hot combustion gases from which energy is extracted by downstream turbine stages. A high pressure turbine (HPT) immediately follows the combustor and is joined by a first rotor or shaft to the upstream compressor which typically includes multiple stages. A low pressure turbine (LPT) is disposed downstream of the HPT and produces output power for a second rotor or driveshaft.

In a typical turbofan engine, the LPT is joined to a large fan in front of the compressor for producing propulsion thrust for powering an aircraft in flight. In a land or marine-based engine, the LPT may be joined to an external device for providing power thereto. The engine may be configured for powering a ship, a land vehicle, or an electrical generator in typical applications.

Although the gas turbine engines used in these various applications are fundamentally similar in configuration, they nevertheless must be specifically tailored for those different applications and the different problems associated therewith.

For example, a gas turbine engine configured for a military vehicle, such as a battle tank, must be compact in configuration, readily accessible for field replacement of typical parts, and efficient in operation, with minimal exhaust emissions. These are just several of many competing design objectives for vehicle engines which differ from those associated with aircraft engines.

Vehicle gas turbine engines therefore place a premium on size, weight, and complexity of the engine for maximizing operating range of the vehicle and durability of the engine. The engines must be designed to start and operate in cold or hot environments between sea level and high altitude. Starting is particularly difficult because battery powered, low energy starters must be used to save vehicle weight, and starting requires acceleration of the turbine and compressor rotor to a major percentage of maximum rotor speed representing steady state idle. Turbine rotors may operate at tens of thousands of revolutions per minute (RPM), and steady state idle is typically well above 50 percent maximum rotor speed.

The vehicle turbine engines may be operated with alternate fuels and must operate at high combustion efficiency at very low fuel-to-air ratios just above flameout. And, the accel-to-idle starting of the engine must be free of white smoke emissions, which are typically created when unreacted, evaporated fuel condenses in the exhaust flow. This problem is further increased when a recuperator heat exchanger is used in the engine for preheating compressor air for the combustor by using the hot exhaust gases from the turbine. The recuperator acts as a reservoir for any raw fuel which is discharged thereto due to incomplete combustion, particularly during starting.

Furthermore, efficient fuel atomization is required for achieving efficient combustion, and fuel atomization is affected by the type of fuel injectors and air mixing system.

For example, relatively simple airblast fuel injectors are conventional and cooperate with surrounding air swirlers mounted to the dome end of the combustor for producing fuel and air mixtures. Fuel atomization is affected by the flow rate and pressure of the swirler air which are relatively low during engine starting.

In contrast, fuel-pressurizing injectors, such as the common duplex fuel injector, are configured for using high pressure fuel for finely atomizing the fuel during starting or above idle operation of the engine. However, such pressurizing injectors are more complex than airblast injectors and require a more powerful fuel pump for providing sufficient fuel pressure during starting and above idle performance.

Accordingly, it is desired to provide an improved combustor for a vehicle gas turbine engine, and corresponding method of starting thereof.

BRIEF DESCRIPTION OF THE INVENTION

A combustor includes outer and inner liners joined together by a dome to define a combustion chamber. A row of air swirlers is mounted in the dome and includes corresponding main fuel injectors for producing corresponding fuel and air mixtures. Pilot fuel injectors fewer in number than the main injectors are mounted in the dome between corresponding ones of the swirlers. Staged fuel injection from the pilot and main injectors is used for starting the combustor during operation.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
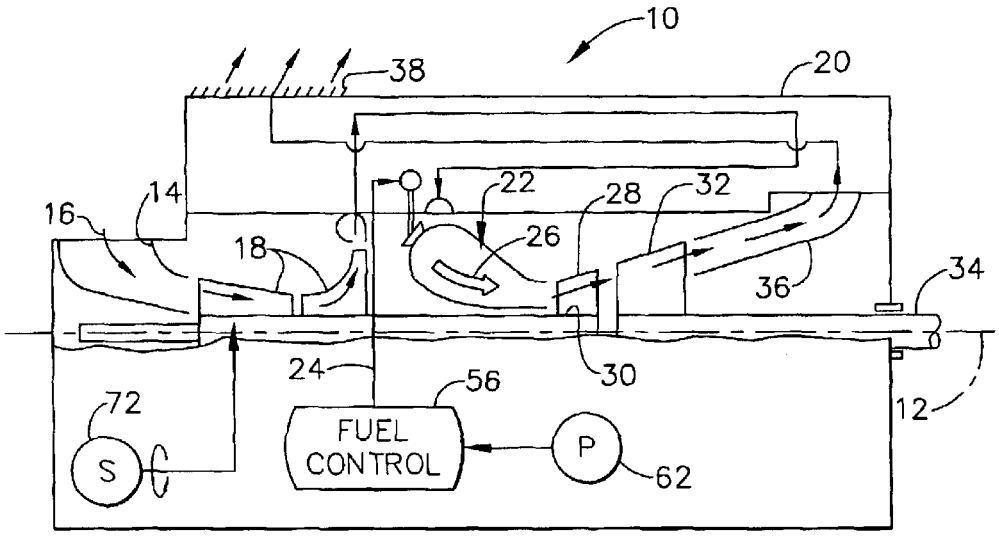
FIG. 1 is an axial schematic view of a land-based vehicle gas turbine engine in accordance with an exemplary embodiment.

Illustrated schematically in FIG. 1 is a gas turbine engine 10 specifically configured for use in a land-based vehicle (not shown) for providing propulsion power therefor. The engine is axisymmetrical about a longitudinal or axial centerline axis 12 and includes at an upstream end an inlet 14 for receiving ambient air 16.

Following the inlet is a multistage, axi-centrifugal compressor 18 that pressurizes the air 16 which is then discharged therefrom into a surrounding recuperator or heat exchanger 20. The compressor discharge air is heated in the recuperator, as further described hereinbelow, and suitably returned to the upstream end of an annular combustor 22.

Fuel 24 is mixed with the pressurized air 16 and ignited in the combustor for generating hot combustion gases 26 therein which are discharged from the downstream, outlet end thereof to a single stage high pressure turbine (HPT) 28. The rotor disk of the HPT 28 is suitably joined to a first rotor or shaft 30 which extends upstream to the forward end of the engine for providing power to the rotor of the compressor attached thereto.

A two stage low pressure turbine (LPT) 32 is disposed downstream from the HPT for further extracting energy from the combustion gases 26 received therefrom. The LPT has a second rotor or output driveshaft 34 which extends from the aft end of the engine for providing power to a transmission (not shown) in the vehicle.

The engine also includes a transition duct 36 extending from the LPT 32 to the recuperator 20 for channeling therethrough the hot combustion exhaust gases from the engine, which in turn heat the compressor discharge air also channeled through the recuperator from the compressor in the flowpath to the combustor. The recuperator is a heat exchanger having separate flowpaths for the compressor air and the exhaust gases which permits heat transfer therebetween. The combustion gases are discharged from the engine through a suitable outlet 38.

Figure 2:
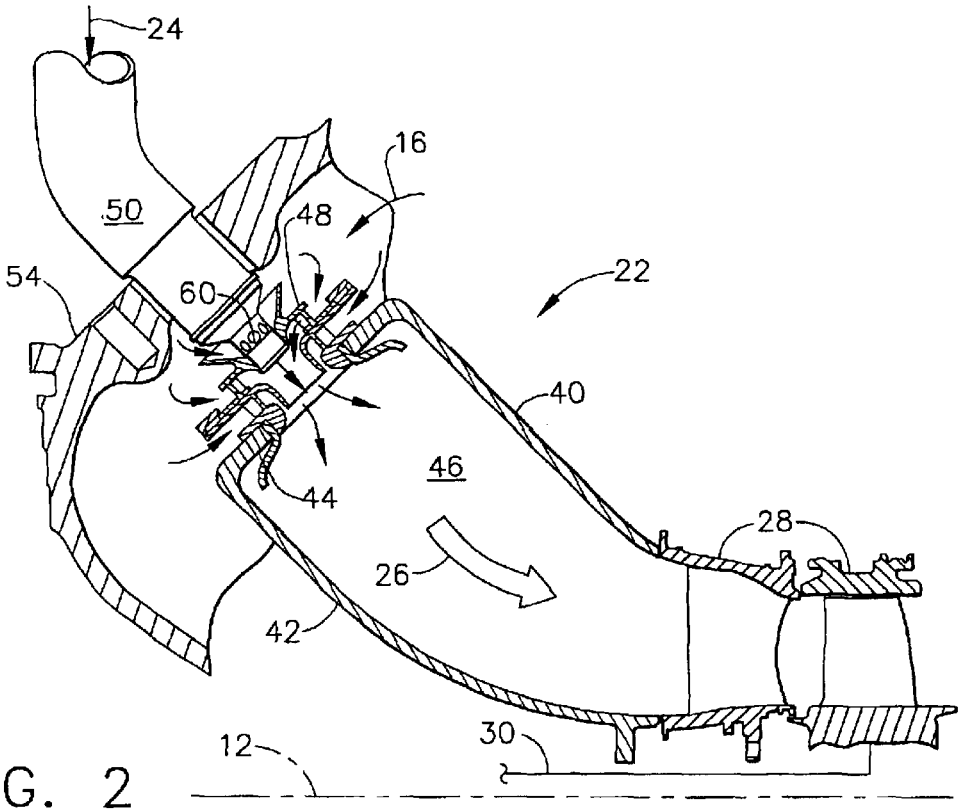
FIG. 2 is a partly sectional, axial view of a portion of the annular combustor illustrated in FIG. 1, including main fuel injectors and cooperating air swirlers.

The combustor 22 is illustrated in FIG. 2 in accordance with an exemplary embodiment and is axisymmetrical about the engine centerline axis 12. The combustor is an assembly of parts including an annular, radially outer combustion liner 40 spaced radially outwardly from an annular, radially inner combustion liner 42. The upstream ends of the two liners are joined together by a single annular dome 44 for defining an annular combustion chamber 46 between the two liners extending downstream from the dome to an open annular outlet at the downstream ends of the liners. The combustion gases 26 generated during operation in the combustion chamber 46 are discharged from the combustor into the annular stator nozzle of the HPT 28 for flow in turn through the row of first stage turbine rotor blades which extract energy therefrom for rotating the first shaft 30 to drive the compressor.

A row of air swirlers 48 is suitably mounted through corresponding apertures in the dome 44 for swirling the pressurized air 16 through the dome and into the combustion chamber.

Correspondingly, a row of main fuel injectors 50 is mounted in respective ones of the swirlers 48 for injecting the fuel 24 for mixing with the swirled air 16 to form corresponding fuel and air mixtures which are ignited for generating the hot combustion gases 26. The air swirlers 48 may have any conventional configuration, such as the counterrotating embodiment illustrated, including two rows of oppositely radially inclined turning vanes which swirl the air radially inwardly to surround the fuel being discharged from the respective fuel injectors 50. The cooperating pairs of fuel injectors and swirlers each define a corresponding main carburetor for providing atomized fuel and air for combustion in the combustion chamber.

Figure 3:
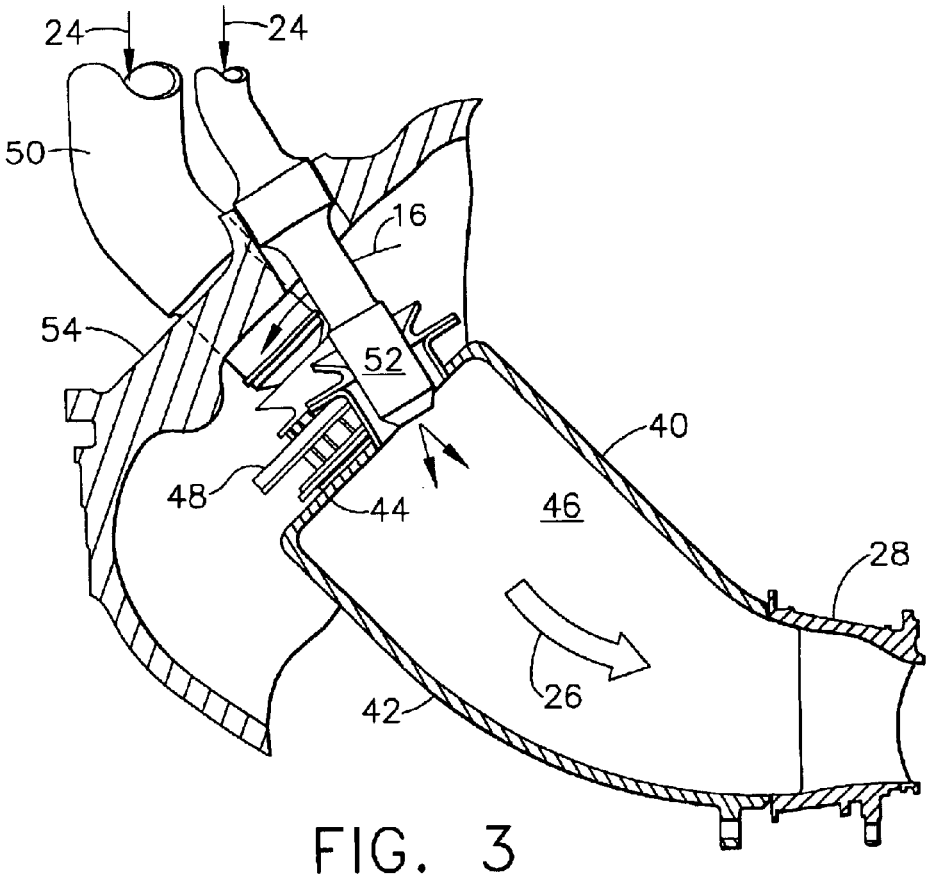
FIG. 3 is a partly sectional, axial view of a portion of the combustor illustrated in FIG. 1 in a different plane than that of FIG. 2 illustrating a row of pilot fuel injectors therein.

FIG. 3 illustrates another axial plane of the combustor circumferentially offset from the plane illustrated in FIG. 2 in which the dome 44 further includes a plurality of pilot fuel injectors 52 suitably mounted through corresponding apertures therein. The pilot injectors 52 are fewer in number or quantity than the larger number of main injectors 50, and are disposed circumferentially between corresponding ones of the air swirlers 48 through which the main injectors are mounted.

The main injectors 50 illustrated in FIG. 2 and the pilot injectors 52 illustrated in FIG. 3 are suitably mounted through a common combustor casing 54 which surrounds the combustion chamber and its dome end. Compressor discharge air 16 is suitably channeled from the recuperator illustrated in FIG. 1 inside the combustor casing for flow into the combustion chamber through the row of air swirlers 48. Correspondingly, the fuel 24 is suitably channeled through the main and pilot injectors 50,52 for mixing with the pressurized air to produce the combustion gases 26.

As initially shown in FIG. 1, suitable means in the form of a fuel controller 56 are provided in the engine and operatively joined to the main and pilot injectors 50,52 for preferentially staging fuel introduction and delivery firstly to the pilot injectors 52, and following in turn both temporally and spatially circumferentially to the main injectors 50. Such fuel staging may be used to advantage in starting the combustor in acceleration (accel) from zero speed of the first rotor 30 to steady state idle speed representing a major percentage of maximum rotor speed, typically greater than 50 percent.

Figure 4:
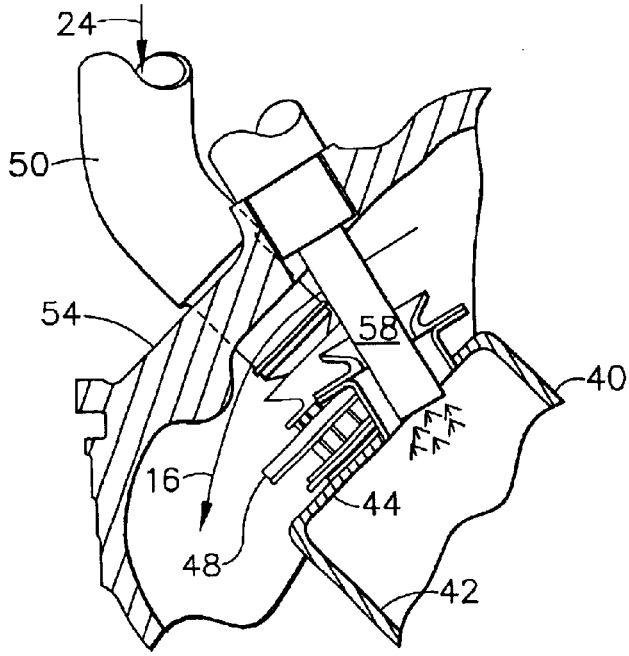
FIG. 4 is a partly sectional, axial view, like FIG. 3, of another plane of the combustor illustrating an igniter therein.

Starting is further effected by the use of a pair of electrical igniters 58 suitably mounted through corresponding apertures in the combustor dome 44 as illustrated in FIG. 4. The two igniters 58 extend radially inwardly through the combustor casing 54 and are interspersed circumferentially between the main injectors 50 and the pilot injectors 52, as additionally illustrated in FIG. 5.

The dome 44 illustrated in FIGS. 2–5 is a single annular dome in which the main swirlers 48 are arranged in a substantially continuous row with maximum individual size in the limited space of the dome. The air swirlers are generally mounted in the radial middle portion of the dome, and extend in size radially outwardly and inwardly toward the corresponding liners.

In this way, the main air swirlers and their cooperating main fuel injectors may be sized and configured for producing maximum power in the combustor with corresponding maximum efficiency of operation. And, the air swirlers and their fuel injectors are equidistantly spaced apart circumferentially around the combustor dome for providing a substantially uniform temperature pattern factor of the combustion gases discharged to the first stage turbine nozzle.

Figure 5:
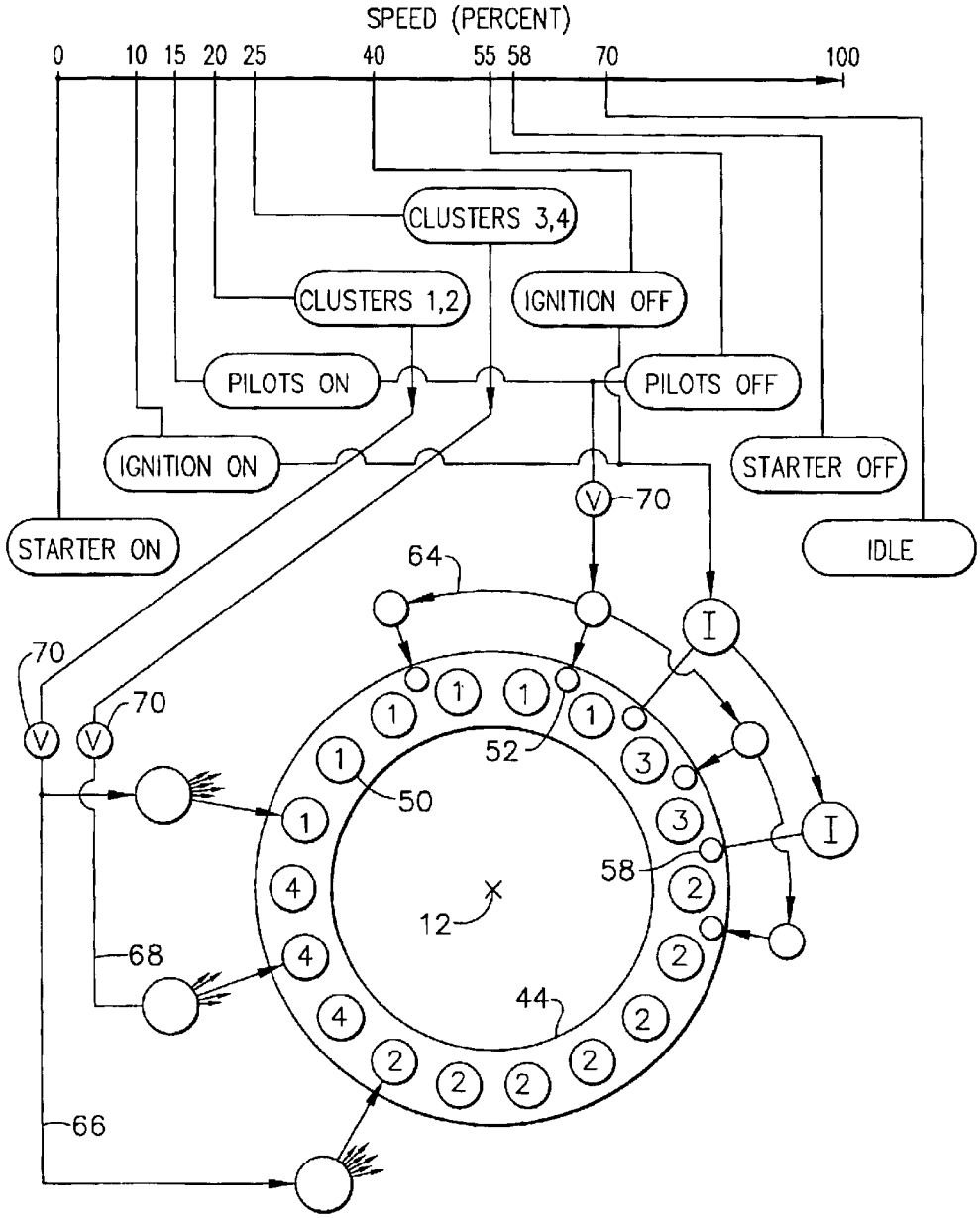
FIG. 5 is a schematic representation of the combustor illustrated in FIGS. 1–4 and a cooperating flowchart for starting thereof in accordance with an exemplary embodiment.

The pilot injectors 52 introduced above are provided for improving starting capability of the engine and are substantially fewer in number than the main injectors and preferentially located. As illustrated in FIGS. 3 and 5, the pilot injectors 52 are spaced between adjacent ones of the main injectors 50 where space permits in the limited dome, and extend through the radially outer portion of the dome in the corresponding triangular regions between the circular air swirlers. The individual air swirlers and their main injectors are correspondingly spaced radially inwardly from the pilot injectors in the radial middle portion of the dome.

Correspondingly, the igniters 58 illustrated in FIGS. 4 and 5 are similarly mounted in the combustor dome 44 where space permits. And, like the pilot injectors, the igniters 58 are also mounted in the radially outer portion of the dome in the corresponding triangular spaces formed between adjacent circular air swirlers.

By introducing both main and pilot fuel injectors 50,52 the two types of fuel injectors may be different from each and specifically tailored for maximizing combustor performance at idle and above, as well as maximizing combustor performance during starting acceleration to idle. In particular, the main injectors 50 are in the preferred form of airblast-atomizing injectors, which require cooperation with the corresponding air swirlers 48 for suitably atomizing the fuel as it is mixed with the pressurized air.

Airblast fuel injectors are well known and may be specifically configured for use with the counterrotating air swirlers 48 illustrated in FIG. 2. Each main injector has a distal end or tip slidingly mounted in the ferrule end of the swirler 48 for injecting fuel therethrough. The injector tip includes a row of side apertures 60 which receive a portion of the pressurized air 16 to assist in atomizing the fuel discharged from the injector tip. The so discharged fuel and air streams from the injector then undergo mixing with the counterrotating streams of air discharged radially inwardly through the respective air swirlers for atomizing the injected fuel.

However, atomization of the fuel injected from the airblast injectors is a function of the pressure and flowrate of the compressor discharge air, which are both relatively low during the starting sequence of the engine from zero rotor speed to idle speed. Accordingly, engine starting would be compromised if the main fuel injectors alone were used for starting.

However, the pilot injectors 52 are specifically configured and located for providing enhanced fuel atomization during the starting sequence for improving combustion efficiency thereof, and substantially eliminating the undesirable white smoke emissions which would otherwise occur from incomplete combustion of fuel injection from the main injectors if used alone for starting the engine. The pilot injectors are preferably in the form of fuel-pressure atomizing injectors having any conventional configuration for providing efficient fuel atomization during the starting sequence.

As illustrated in FIG. 3, the pilot injectors 52 extend through the combustor dome 44 without cooperating air swirlers therearound, as otherwise used around the main injectors 50. Whereas the main injectors rely on the air swirlers 48 for fuel atomization, the pilot injectors 52 do not. The pressure atomizing pilot injectors 52 rely solely on fuel pressure for providing fuel atomization with a suitable spray cone angle for efficient starting operation of the combustor.

As illustrated schematically in FIG. 1, a fuel pump 62 is operatively joined to the fuel controller 56 for providing fuel under pressure to both the main and pilot injectors 50,52. However, that fuel pump 62 may be relatively simple since it need only be configured for providing relatively high fuel pressure to the few number of pilot injectors 52 during starting of the engine, and then after engine starting less pressure is required of the fuel pump for delivering fuel to the larger number of main injectors which operate from idle to maximum power of the engine. At maximum power, full pump pressure is then needed to supply all main injectors.

A preferred configuration and cooperation of the differently configured main and pilot fuel injectors 50,52 is illustrated schematically in FIG. 5. The pilot injectors 52 are disposed or grouped in a single common pilot cluster in a circumferentially minor portion or sector of the dome 44. The dome 44 is illustrated vertically in FIG. 5 relative to its preferred location in a military vehicle, such as a tank. The pilot cluster of injectors is distributed in the circumference of the dome slightly more than the first quadrant thereof.

The main injectors 50 are grouped in first and second main clusters, designated respectively by the numerals 1,2, each cluster overlapping circumferentially opposite ends of the pilot cluster in the dome second and fourth quadrants.

Although the entirety of the main injectors 50 are uniformly spaced around the circumference of the dome in all four quadrants thereof, the preferred groupings or clusters thereof provide enhanced starting capability as described hereinbelow. For example, the main injectors 50 are further grouped in a third main cluster, designated by the numeral 3, which injectors are interspersed in the pilot cluster of injectors over the first quadrant. And, the remaining main injectors 50 are grouped in a fourth main cluster designated by the numeral 4, which is disposed circumferentially or diametrically opposite to the third cluster in the dome third quadrant.

In one embodiment built and tested for enhanced starting capability, the first cluster includes six main injectors, the second cluster includes seven main injectors, the third cluster includes two main injectors, and the fourth cluster includes three main injectors which cooperate with preferably four pilot injectors in the specifically configured pilot cluster thereof.

The various pilot and main clusters are preferentially fueled for enhanced combustor performance, including starting thereof. For example, a first fuel manifold or distribution block 64 is joined in flow communication to the pilot cluster of injectors 52. A second fuel manifold or distributor block 66 is joined in flow communication to both the first and second main clusters of injectors 50. A third fuel manifold or distributor block 68 is joined in flow communication to the third and fourth clusters of main injectors 50.

Correspondingly, the fuel controller 56 illustrated in FIG. 1 is operatively joined to the three manifolds 64,66,68 illustrated in FIG. 5 by corresponding flow valves 70 which may be selectively opened and closed for staging fuel flow sequentially in turn to the first, second, and third manifolds.

The fuel manifolds are preferentially operated to stage fuel to the main and pilot injectors 50,52 for enhanced starting of the combustor to steady state idle operation of the engine, followed in turn by efficient combustor performance upwardly therefrom to maximum power. As indicated above, the main injectors 50 are equidistantly spaced apart around the circumference of the dome as illustrated in FIG. 5 at a common pitch spacing represented by the 360 degree circumference divided by the eighteen total number thereof.

The pilot injectors 52 are located solely in the minor sector of the dome, with each pilot injector alternating circumferentially with corresponding main injectors in the minor sector. And, the two igniters 58 are also located generally in the middle of the minor sector alternating also with the main and pilot injectors.

The two igniters 58 are Line Replaceable Units (LRUs) which correspondingly limit their preferred location in the combustor dome so that they may be conveniently accessible for removal from the engine installed in the vehicle. The placement in the combustor dome of the igniters then determines the corresponding placement of the pilot sector within the remaining main injectors. And, the grouping of the main injectors into the preferred four clusters illustrated in FIG. 5 follows in turn the location of the pilot injectors near the igniters.

Although one pilot injector 50 could be used for initially starting the combustor during operation, that injector would be relatively large for carrying sufficient fuel flow to generate sufficient combustion gases for powering the HPT during start up to steady state idle. Correspondingly, a local hot streak would be developed from that single pilot injector and cause undesirable heating of the downstream components therefrom.

Accordingly, a plurality of the pilot injectors 52 are preferred for distributing the required fuel for starting, reducing the corresponding hot streaks, and improving circumferential uniformity of the gas temperature in its commonly known pattern factor.

In the preferred embodiment illustrated in FIG. 5, four of the pilot injectors 52 are preferred and define the minor sector of the dome which extends slightly over the dome first quadrant. In the first quadrant, the pilot injectors alternate in turn with the adjoining main injectors of the three adjoining clusters 1,2,3, including the two igniters also disposed therein.

One of the pilot injectors 52 is located in the second quadrant of the dome offset by two main injectors for injecting some fuel into the left-side of the dome illustrated in FIG. 5 for additionally spreading the fuel load.

In the first quadrant illustrated in FIG. 5, three pilot injectors 52 are located closely adjacent to the corresponding igniters on opposite circumferential sides thereof within the range of the igniters for initiating the combustion process by igniting the atomized fuel sprays from the pilot injectors. Furthermore, the four pilot injectors are sufficiently spaced close enough to each other so that combustion initiation may also be obtained by crossfire and propagation of the flame from pilot to pilot and from one or more of the igniters. The two igniters provide redundancy of starting operation.

A preferred method of starting the combustor and engine is illustrated schematically in FIG. 5. An electrical starter 72, as illustrated in FIG. 1, is suitably mounted in the engine for cranking or turning the first rotor 30 to initially rotate and accelerate the compressor 18 and rotor blades of the HPT 28. The starter may have any suitable configuration, such as the typical battery powered, low energy starter.

The starting sequence begins by operating or powering the starter 72 to initially accelerate the rotor 30 from zero speed to pressurize air 16 in the compressor 18 for flow to the combustor. At about ten percent maximum speed of the rotor 30, the igniters 58 are electrically powered on to produce the initiation spark for combustion.

At about 15 percent maximum rotor speed, the fuel controller is operated for staging a pilot fuel portion firstly to the first manifold 64 for discharge from all four pilot injectors 52. No fuel is provided to the main injectors at this time. Since the pilot injectors 52 are preferably pressure-atomizing injectors, they finely atomize the fuel discharged therefrom which is mixed with the initially small volume of pressurized air delivered to the combustor from the slowly rotating compressor rotor. The mixture of pilot fuel and pressurized air is ignited by the igniters and propagated across the corresponding minor sector of the dome to produce combustion gases discharged to the HPT which extracts energy therefrom for assisting in powering the compressor during start up.

Commencing at about 20 percent maximum rotor speed, the fuel controller is operated for staging a main fuel portion to the main injectors 50 in a preferred sequence following in time fuel initiation or commencement of fuel flow from the pilot injectors.

In the preferred embodiment illustrated in FIG. 5, the fuel controller is operated for staging main fuel to the second manifold 66 for discharge collectively from the main injectors 50 in the first and second clusters on opposite circumferential sides of the pilot cluster. Since the pilot cluster initiates the combustion reaction, the adjoining and circumferentially overlapping first and second clusters may be ignited by crossfire and propagation from the pilot flame.

Staging of fuel to the first and second main injector clusters thusly commences after fueling of the pilot injectors, at about 20 percent maximum rotor speed, for example.

It is noted that the mechanical starter first begins the acceleration of the first rotor 30, followed in turn by further acceleration of the rotor as the pilot flame is produced in the combustion chamber from the pilot injectors. And, the first rotor 30 is further accelerated as additional fuel is provided by the first and second main clusters of injectors which begins the main flame in the combustion chamber. As the rotor accelerates, the pressure and volume of the air delivered to the combustor by the compressor increases, which increases the efficiency of fuel atomization from the main injectors with the air being swirled by the corresponding swirlers 48.

By initially staging only some, but not all, of the main injectors 50 in the first two clusters, the introduction of main fuel with the available compressor discharge air may be optimized for optimizing combustor starting and reducing emissions therefrom, such as the undesirable white smoke emissions which would otherwise occur from incompletely burned fuel due to poor atomization thereof.

As the first rotor 30 increases in speed due to the combined effects of the electrical starter, pilot flame from the pilot cluster, and initial main flame from the first and second main clusters, the pressure and flowrate of air from the compressor further increases. Accordingly, the fuel controller may then be used to stage additional fuel to the third manifold 68 for discharge from the remaining main injectors in the third and fourth clusters which mixes with the pressurized air channeled through the corresponding swirlers, and further adds energy to the main flame to further accelerate the first rotor. The fuel and air mixtures discharged from the third and fourth clusters are ignited by crossfire and propagation from both the pilot injectors and the main injectors in the first two main clusters.

Accordingly, at about 25 percent maximum rotor speed, the pilot and main fuel injectors have been progressively provided with fuel for corresponding with the progressive increase in pressure and flowrate of air from the accelerating rotor and compressor for developing the main combustion flame circumferentially around the entire extent of the combustion chamber. Fuel flow through the main injectors may then be suitably increased as the rotor correspondingly accelerates in speed, with the main fuel being more efficiently atomized by the increasing flowrate of the pressurized air channeled through the corresponding air swirlers.

At a suitable rotor speed, for example 40 percent maximum speed, the igniters may be turned off following stable operation of the combustion flame. The main combustion flame from the main injectors may then be sufficiently stable for in turn terminating fuel flow to the pilot cluster for turning off the pilot injectors at a suitable rotor speed, such as 55 percent maximum speed. The pilot injectors may then be suitably provided with purge air therethrough for purging any remaining fuel therein for reducing the likelihood of coking thereof.

The electrical starter may then be disconnected or cut-out from the compressor rotor at a suitable speed, such as about 58 percent maximum rotor speed, with the compressor rotor then being powered solely by energy extraction from the combustion gases in the high pressure turbine.

The full complement of main injectors 50 are then provided with fuel, with the fuel controller then further increasing flowrate of that main fuel thereto to further accelerate the compressor rotor to the desired steady state idle speed of about 70 percent maximum rotor speed for example.

The introduction of the few number of pilot injectors interspersed in the single row of main fuel injectors, and staged operation thereof permits precise tailoring of the combustion process from flame initiation to steady state idle, and upwardly to maximum power. The few pilot injectors may be specifically configured as pressure-atomizing injectors for maximizing combustion efficiency during startup without requiring the increased complexity of a high pressure fuel pump. The airblast main injectors 50 may be relatively simple and can enjoy efficient operation with their cooperating air swirlers particularly at idle to maximum power operation of the engine.

Staged operation of the main injectors permits their use during corresponding portions of the starting sequence. In particular, the first and second main clusters are fueled together simultaneously following fueling of the pilot injectors. The third and fourth main clusters are also fueled simultaneously together, but only after commencement of fueling of the first and second main clusters. In this way, the required fuel load during the starting sequence may be efficiently distributed between the pilot and main injectors in staging both temporally and spatially around the circumferential extent of the combustor dome.

The four clusters of main injectors and the specific number of individual injectors therein are merely exemplary of the many permutations thereof. The pilot injectors are interspersed within the main injectors for commencing the starting sequence and permitting crossfire propagation of the combustion flame. The sequential staging of the main injectors permits tailoring of the fuel rate therefrom to better match the available flowrate of pressurized air from the compressor as it accelerates during the starting sequence. The grouping of the main injectors in the first and second clusters on opposite sides of the dome in substantial symmetry in the second and fourth quadrants ensures the symmetry of the main combustion flame as it develops, for in turn ensuring symmetry and suitable pattern factor of the gas temperature as the gases are discharged into the high pressure turbine.

Similarly, the third and fourth main clusters are disposed on opposite sides of the combustor dome in the first and third quadrants. The fewer main injectors in the pilot cluster in the dome first quadrant cooperate with the pilot injectors for collectively discharging fuel in balance with the larger number of main injectors in the fourth cluster in the third dome quadrant.

In this way, the main injectors 50 and their cooperating air swirlers 48 may have a single and identical design and configuration, and are operated in stages during the starting sequence. The pilot injectors 52 also have identical designs and configurations which are different than the main injectors, for complementing their different purposes in the combustor. And, collectively the main and pilot injectors permit enhanced operation and efficiency of the engine during both the starting sequence to steady state idle, as well as at all power settings thereabove to maximum.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A combustor comprising:

annular outer and inner combustion liners joined together at upstream ends by an annular dome to define a combustion chamber therebetween;

a row of air swirlers mounted in said dome for swirling air into said chamber;

a row of main injectors mounted in said swirlers for injecting fuel for mixing with said swirled air to form corresponding fuel and air mixtures;

a plurality of pilot injectors fewer in number than said main injectors, and mounted in said dome between corresponding ones of said swirlers for injecting fuel into said chamber;

a common fuel manifold joined to said plurality of pilot injectors and having a common flow valve to control fuel flow thereto;

at least one common fuel manifold joined to said plurality of main injectors and having a common flow valve to control fuel flow thereto; and a controller operatively joined to said flow valves for staging fuel delivery to said manifolds firstly to only said pilot injectors and following in turn circumferentially to said main injectors.

2. A combustor according to claim 1 wherein:

said pilot injectors are grouped in a common pilot cluster in a circumferentially minor sector of said dome, and extend through a radially outer portion of said dome; and said main injectors are grouped in first and second main clusters, each overlapping circumferentially opposite ends of said pilot cluster, and being disposed radially inwardly therefrom in a radial middle portion of said dome.

3. A combustor according to claim 2 wherein;

said main injectors are further grouped in a third main cluster and interspersed in said pilot cluster, and in a fourth main cluster disposed opposite to said third cluster in said dome middle portion;

said pilot cluster is joined to a first fuel manifold having a first flow valve;

said first and second clusters are joined to a second fuel manifold having a second flow valve; and said third and fourth clusters are joined to a third fuel manifold having a third flow valve.

4. A combustor according to claim 3 further comprising a pair of igniters mounted in said outer portion of said dome minor sector interspersed in said main injectors and said pilot injectors.

5. A combustor comprising:

annular outer and inner combustion liners joined together at upstream ends by an annular dome to define a combustion chamber therebetween;

a row of air swirlers mounted in said dome for swirling air into said chamber;

a row of main injectors mounted in said swirlers for injecting fuel for mixing with said swirled air to form corresponding fuel and air mixtures;

a plurality of pilot injectors fewer in number than said main injectors, and mounted in said dome between corresponding ones of said swirlers for injecting fuel into said chamber, said pilot injectors are grouped in a common pilot cluster in a circumferentially minor sector of said dome, and extend through a radially outer portion of said dome; and wherein said pilot injectors comprise fuel-pressure atomizing injectors extending through said dome without cooperating air swirlers therearound; and a controller operatively joined to said main and pilot injectors for staging fuel delivery thereto firstly to said pilot injectors and following in turn circumferentially to said main injectors.

6. A combustor according to claim 5 wherein said main injectors comprise airblast-atomizing injectors, each having a tip with side apertures for receiving air.

7. A combustor according to claim 6 wherein said main and pilot injectors alternate circumferentially in said minor sector.

8. A combustor according to claim 7 further comprising:

a first fuel manifold joined to said pilot cluster;

a second fuel manifold joined to said first and second main clusters; and a third fuel manifold joined to said third and fourth main clusters.

9. A combustor according to claim 8 wherein said controller is operatively joined to said first, second, and third manifolds for staging fuel flow sequentially in turn thereto.

10. A method of starting said combustor according to claim 8 in a gas turbine engine including an upstream compressor joined by a rotor to a downstream turbine, comprising:

operating a starter to accelerate said rotor and produce pressurized air in said compressor for flow to said combustor;

staging pilot fuel to said pilot cluster for producing a pilot flame in said combustion chamber to further accelerate said rotor;

staging main fuel to said first and second main clusters for mixing with said pressurized air channeled through said swirlers to produce a main flame ignited by said pilot flame to further accelerate said rotor;

staging main fuel to said third and fourth main clusters for mixing with said pressurized air channeled through said swirlers to add to said main flame and further accelerate said rotor;

terminating fuel flow to said pilot clusters;

disconnecting said starter from said rotor; and fueling all said main clusters to further accelerate said rotor to steady state idle speed.

11. A combustor comprising:

annular outer and inner combustion liners joined together at upstream ends by an annular dome to define a combustion chamber therebetween;

a row of air swirlers mounted in said dome for swirling air into said chamber;

a row of main injectors mounted in said swirlers for injecting fuel for mixing with said swirled air to form, corresponding fuel and air mixtures;

a plurality of pilot injectors fewer in number than said main injectors, and mounted in said dome between corresponding ones of said swirlers for injecting fuel into said chamber;

a common fuel manifold joined to said plurality of pilot injectors and having a common flow valve to control fuel flow thereto; and two fuel manifolds joined to said plurality of main injectors and having corresponding flow valves to control fuel flow thereto.

12. A method of starting said combustor according to claim 11 comprising:

staging pilot fuel firstly to said pilot injectors;

staging main fuel secondly to said main injectors following in time fuel commencement to said pilot injectors; and terminating fuel flow to said pilot injectors following in time fuel commencement to said main injectors.

13. A combustor comprising:

annular outer and inner combustion liners joined together at upstream ends by an annular dome to define a combustion chamber therebetween;

a row of air swirlers mounted in said dome for swirling air into said chamber;

a row of main injectors mounted in said swirlers for injecting fuel for mixing with said swirled air to form corresponding fuel and air mixtures; and a plurality of pilot injectors fewer in number than said main injectors, and mounted in said dome between corresponding ones of said swirlers for injecting fuel into said chamber; and said pilot injectors are grouped in a common pilot cluster in a circumferentially minor sector of said dome; and said main injectors are grouped in first and second main clusters each overlapping circumferentially opposite ends of said pilot cluster.

14. A combustor according to claim 13 wherein said main injectors are further grouped in a third main cluster and interspersed in said pilot cluster, and in a fourth main cluster disposed opposite to said third cluster.

15. A combustor according to claim 14 further comprising:

a first fuel manifold joined to said pilot cluster;

a second fuel manifold joined to said first and second main clusters; and a third fuel manifold joined to said third and fourth main clusters.

16. A combustor according to claim 15 further comprising a controller operatively joined to said first, second, and third manifolds for staging fuel flow sequentially in turn thereto.

17. A method of starting said combustor according to claim 15 comprising:

staging pilot fuel firstly to said first manifold for discharge from said pilot injectors;

staging main fuel secondly to said second manifold for discharge from said main injectors in said first and second clusters;

staging main fuel thirdly to said third manifold for discharge from said main injectors in said third and fourth clusters; and terminating fuel flow to said pilot injectors following fuel flow to all said main clusters.

18. A combustor according to claim 14 further comprising a pair of igniters mounted in said dome minor sector interspersed in said main injectors and said pilot injectors.

19. A combustor according to claim 18 wherein said main and pilot injectors alternate circumferentially in said minor sector.

20. A combustor according to claim 14 wherein said pilot injectors comprise fuel-pressure atomizing injectors extending through said dome without cooperating air swirlers therearound.

21. A combustor according to claim 20 wherein said main injectors comprise airblast-atomizing injectors.

22. A method of starting said combustor according to claim 14 in a gas turbine engine including an upstream compressor joined by a rotor to a downstream turbine, comprising:

operating a starter to accelerate said rotor and produce pressurized air in said compressor for flow to said combustor;

staging pilot fuel to said pilot cluster for producing a pilot flame in said combustion chamber to further accelerate said rotor;

staging main fuel to said first and second main clusters for mixing with said pressurized air channeled through said swirlers to produce a main flame ignited by said pilot flame to further accelerate said rotor;

staging main fuel to said third and fourth main clusters for mixing with said pressurized air channeled through said swirlers to add to said main flame and further accelerate said rotor;

terminating fuel flow to said pilot clusters;

disconnecting said starter from said rotor; and fueling all said main clusters to further accelerate said rotor to steady state idle speed.

23. A method according to claim 22 wherein said third and fourth are fueled after commencement of fueling of said first and second clusters.

24. A method according to claim 23 wherein said first and second clusters are fueled simultaneously, and said third and fourth clusters are fueled simultaneously.

* * * * *